United States Patent [19]

Shigeta et al.

[11] Patent Number: 4,621,248

[45] Date of Patent: Nov. 4, 1986

[54] AMORPHOUS CUT CORE

[75] Inventors: Masao Shigeta, Urayasu; Shotatsu Sugenoya; Tsutomu Cho, both of Ichikawa, all of Japan

[73] Assignee: TDK Corporation, Tokyo, Japan

[21] Appl. No.: 621,358

[22] Filed: Jun. 18, 1984

[30] Foreign Application Priority Data

Jun. 16, 1983 [JP] Japan ..... 58-108461

[51] Int. Cl.[4] ..... H01F 27/24

[52] U.S. Cl. ..... 336/178; 29/605; 336/213; 336/219; 336/234

[58] Field of Search ..... 148/403, 31.55; 29/605, 29/609; 360/125, 126; 365/34; 336/213, 219, 178, 234

[56] References Cited

U.S. PATENT DOCUMENTS 2,293,951 8/1942 Seastone et al. ..... 336/219 X 2,554,262 5/1951 Nagel ..... 336/219 X

*Primary Examiner*—Thomas J. Kozma

*Attorney, Agent, or Firm*—Armstrong, Nikaido, Marmelstein & Kubovcik

[57] ABSTRACT

The present invention relates to a core of magnetic amorphous alloy. A thin strip of such alloy is wound and then cut to provide, e.g., C-shaped pieces. A pair of C-shaped pieces is assembled to provide the core. Conventionally, the magnetic properties, e.g., the watt loss, of the core are impaired at the cut ends of a thin strip due to the formation of burrs.

The present invention is characterized by providing the cut ends with a thickness substantially the same as the thickness of the non-cut portion of the thin strip and by polishing the cut ends substantially parallel to the major surface of the thin strip, thereby improving the magnetic properties of the core.

1 Claim, 9 Drawing Figures

AMORPHOUS CUT CORE

BACKGROUND OF THE INVENTION

1. Field of the Invention

The present invention relates to a cut core which comprises a thin strip of magnetic amorphous alloy and which is used for various kinds of inductors and transformers. The present invention also relates to a method for manufacturing the cut core.

2. Description of the Prior Art

As is well known, the cores of inductors or the like are either wound or laminated cores. When the cores are manufactured by using a thin strip of magnetic amorphous alloy, such thin strip is wound, i.e., wound bodies are produced, in the light of the productivity of the cores. The wound bodies are cut into U-, C-, or I-shaped pieces. Usually, a pair of the so-produced cut pieces is connected either with a spacer or without a spacer to form a core, in which the cut end of one of the cut pieces faces the cut end of the other cut piece. Occasionally, for example, an I-shaped cut piece is connected with a C-shaped cut piece to form a D-shaped core, the cut ends not facing one another. Such core including a cut end(s) and comprising a thin strip of magnetic amorphous alloy is hereinafter referred to as an amorphous cut core.

According to a conventional method for manufacturing an amorphous cut core, a thin strip of magnetic amorphous alloy is wound into a toroidal form, and the wound body is impregnated with resin, is mounted in a casing or is fixed with a caulking member such as a bobbin, and is then cut into a predetermined shape. Alternatively, two or more wound bodies are formed and then fixedly bonded to each other, and the bonded wound bodies are then cut into a predetermined shape. The wound and cut bodies described above are then polished by rotational polishing so as to smooth their cut ends. This polishing disadvantageously results in an increase in the watt loss and a decrease in the permeability of the amorphous cut core and in an eddy current loss or the generation of interlayer short-circuiting at the cut ends.

It is known in a method for manufacturing cut cores from a silicon steel that the silicon steel sheet is wound, cut, polished, lapped, and chemically polished by etching (Technical Report of the Electric Society (Second Section) Vol. 25, pp 1~15, December 1973). The polishing carried out is rotational polishing or straight polishing across the layers of silicon steel. In this known manufacturing method, the cut ends of the wound body are closely contacted by lapping and polishing so that the watt loss generated at the cut ends is lessened. The lapping and polishing applied to a cut core made of silicon steel cannot be applied to an amorphous cut core for the following reasons.

The packing factor of a wound core made of a silicon steel sheet is from 96% to 97% and is higher than that of an amorphous cut core. Since an amorphous alloy sheet is thin, for example, approximately 20 μm in thickness, and the surface thereof is rougher than that of a silicon steel sheet, which is cold-rolled in the final rolling step, the packing density of the amorphous cut core is low, e.g., from approximately 75% to approximately 83%. Due to the low packing density, gaps are formed between the neighboring layers of the amorphous cut core. The lapping liquid and the etchant of chemical polishing penetrate through the open ends into the interior of the gaps. The so-penetrated lapping liquid and etchant of chemical polishing remain within, and cannot be extracted from the gaps. The liquid and the etchant, particularly a hydrochloric acid- or nitric acid- based etchant, secularly deteriorate the magnetic properties of the amorphous cut core. Since the lapping and chemical polishing disadvantageously result in the penetration of the liquid and the etchant into the amorphous cut core, conventionally, the rotational polishing described above is employed for producing an amorphous cut core. Rotational polishing is conventionally carried out only to such an extent that the burrs formed during cutting are removed only to a certain extent.

However, it is difficult to satisfactorily smoothen the burrs by rotational polishing since an amorphous alloy is elastic and ductile. Also, rotational polishing can disadvantageously result in an increase in the watt loss and an eddy current loss and a decrease in the permeability of an amorphous cut core or the generation of interlayer short-circuiting at the cut ends.

SUMMARY OF THE INVENTION

It is an object of the present invention to provide an amorphous cut core which has a low watt loss and a low secular change of the properties thereof.

It is another object of the present invention to provide a method for manufacturing an amorphous cut core, in which method a watt loss increase and a permeability reduction do not occur at the cut ends due to the cutting of the wound body of a thin strip of magnetic amorphous alloy.

It is a further object of the present invention to provide a method for manufacturing an amorphous cut core, which method does not require chemical polishing of or lapping of the cut ends of the wound body of a thin strip of magnetic amorphous alloy.

In accordance with the present invention, there is provided an amorphous cut core having a predetermined shape and comprising a wound body of a thin strip of magnetic amorphous alloy, the wound body having wound inner and outer surfaces and a cut surface being formed across the wound thin strip of magnetic amorphous alloy, the predetermined shape being defined by the wound inner and outer surfaces, characterized in that the thickness of the thin strip of magnetic amorphous alloy at the cut ends is essentially the same as the thickness of the non-cut portion of the wound thin strip of magnetic amorphous alloy.

DESCRIPTION OF THE PREFERRED EMBODIMENTS

The composition of the magnetic amorphous alloy is not specifically limited in the present invention and may be any known composition which contains an iron-group transition element(s), such as Fe, Co, and Ni, and a vitrification element(s), such as Si, B, P, and C. A preferred composition which can provide a high saturation flux density at a low cost is an Fe-based one containing 20 atomic % or less of Co, Ni, Cr, and/or Mn and from 15 to 30 atomic % or less of Si, B, P, C, and/or Al, the balance being Fe. The magnetic amorphous alloy is produced by a conventional rapid quenching method and may then be subjected to a known heat treatment.

The thickness of the thin strip of magnetic amorphous alloy is from 10 μm to 80 μm. Preferably, the thickness of the thin strip of magnetic amorphous alloy is from 15 μm to 30 μm.

According to yet another embodiment of the present invention, a method for manufacturing an amorphous cut core is provided, the method comprising the steps of:

winding a thin strip of magnetic amorphous alloy, thereby forming a wound body having inner and outer surfaces;

providing the wound body with a shape stability so as to maintain its shape during the subsequent cutting step;

cutting the wound body in a direction substantially perpendicular to the longitudinal direction of the thin strip; and polishing the cut surface in a direction substantially parallel to the major surface of the thin strip of magnetic amorphous alloy.

The shape stability of the wound body can be provided by a known method. For example, a portion(s) of a wound body to be cut is pressed with a jig to firmly bond the wound layers of the thin strip to each other or a wound body is mounted in a casing and then, if necessary, resin is impregnated into the wound body within the casing. Alternatively, resin may be molded around the wound body and allowed to solidify.

The cutting is carried out by a known method by means of a band saw, a grinder, or an electric discharging machine. During the cutting, burrs are formed on the cut ends of the thin strip of magnetic amorphous alloy, with the result that the thickness of the thin strip of magnetic amorphous alloy at the cut ends is at least 1.25 times that of the non-cut portion or the same thickness as before the cutting of the thin strip of magnetic amorphous alloy.

In the polishing step, the polishing of the cut ends is carried out in such a manner that the polishing tool moves on the cut surfaces in a direction substantially parallel to the major surface, and, hence, the cut surfaces are subjected to polishing in this direction. The burrs can be removed by such polishing according to the present invention. If the polishing of the cut surfaces is carried out by a method in which the polishing tool moves in a direction perpendicular to the major surface, the thickness size of the burrs becomes greater than that before polishing, for example, 1.3 times or more the thickness of the thin strip of magnetic amorphous alloy. The polishing is carried out, for example, by means of a belt grinder in which a polishing tool, i.e., an abrasive belt, and the workpiece are slid relative to one another straightly. In the method for manufacturing the amorphous cut core of the present invention, a known polishing, i.e., rotational polishing, may be carried out provided that it is followed by the polishing according to the present invention. It is, however, preferred that the polishing be carried out in a direction parallel to the major surface of the thin strip during the entire polishing step.

According to still another embodiment of the present invention, the thickness of the cut ends is 1.2 times or less the thickness of the non-cut portion.

A preferred embodiment of the present invention is explained with reference to the drawings.

Figure 1:
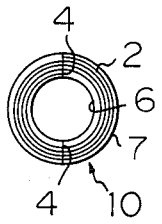
Fig. 1 PRIOR ART
FIG. 1 through 3 show three examples of an amorphous cut core.
Figure 2:
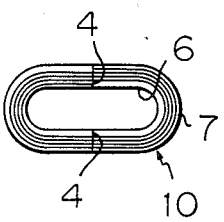
Fig. 2 PRIOR ART
Figure 3:
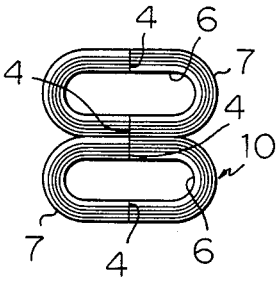
Fig. 3 PRIOR ART

The amorphous cut cores 10 shown in FIGS. 1 through 3 are formed by bonding a pair of C-shaped pieces, a pair of U-shaped pieces, and a pair of E-shaped pieces, respectively, to each other. These pieces are formed by cutting wound core bodies of a thin strip of magnetic amorphous alloy 2. The cut surface is in a direction essentially perpendicular to the longitudinal direction of the thin strip of magnetic amorphous alloy 2. The above-mentioned pairs of pieces are bonded to each other at the cut surface 4. A spacer (not shown) is inserted at the cut surface 4 when the amorphous cut core 10 is used for a choke coil. The shape of the amorphous cut core is determined by the wound inner surface(s) 6 and the wound outer surface 7.

Figure 4:
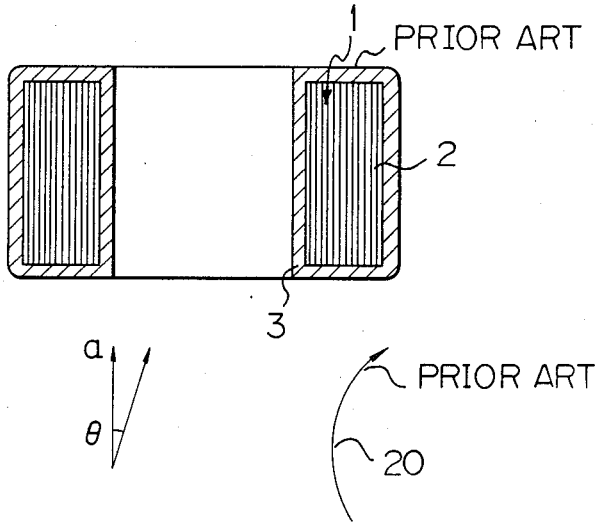
FIG. 4 shows a front view of an amorphous cut core at the cut surface.

Referring to FIG. 4, the wound body for producing an amorphous cut core is denoted by reference numeral 1. The thin strip of magnetic amorphous alloy 2 is wound and is mounted in a casing 3. The wound body 1 is cut, for example, with a band saw as shown in the drawing and is then polished. The polishing is preferably in the direction "a", which is parallel to the major surface of the thin strip of magnetic amorphous alloy 2. However, the polishing direction may be deviated from the direction "a" provided that it is straight and that the angle ($\theta$) between it and the direction "a" is $+30°$ or less. This angle is preferably $+20°$ or less.

If a conventional polishing is carried out, the polishing tool is displaced relative to the wound body 1 in a circular direction 20, and, hence, a burr 2B (FIG. 5) which is generated at the cut end 2C cannot be removed, i.e., it remains substantially unchanged.

Figure 5:
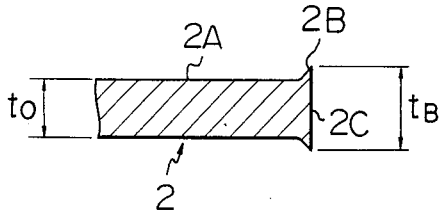
FIG. 5 shows a partial cross section of a wound thin strip of magnetic amorphous alloy.

According to the present invention, in FIG. 5, the thickness $t_B$ at the cut end 2C can be 1.2 times or less the thickness $t_0$ of the non-cut portion 2A of the thin strip of magnetic amorphous alloy. It is also possible for the thickness $t_B$ to be essentially the same as $t_0$, e.g., $t_B = 1.0\ t_0$, when polishing is carried out at a low speed and at an angle $\theta$ of 0°.

Figure 6:
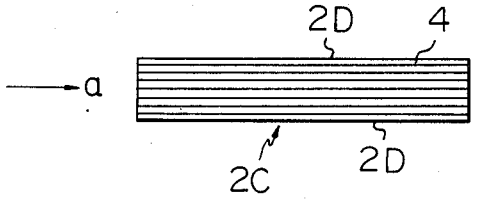
FIG. 6 shows a cut end of a wound thin strip of magnetic amorphous alloy.

In the amorphous cut core according to the present invention, the cut end 2C (FIG. 6) has polishing marks 4 essentially in the direction "a", i.e., parallel to the major surfaces 2D of the thin strip of magnetic amorphous alloy 2.

Since the burrs generated due to cutting are removed by the polishing according to the present invention, it is not necessary to carry out an additional step to prevent short-circuiting between the edges of the cut end. No corrosive-liquid, such as an etchant, is used in the polishing according to the invention, and therefore the intrusion of corrosive liquid into the gap between the layers of an amorphous alloy thin strip does not occur.

The amorphous cut core according to the present invention can be used for manufacturing a core of an inductor, or a transformer. In the manufacture of an inductor, amorphous cut cores of various forms may be combined, e.g., U-U, C-C, U-I, E-E, E-I, or F-F cut cores.

The present invention is hereinafter explained with reference to an example.

EXAMPLE

A magnetic amorphous alloy having a composition of $Fe_{80}Si_{12}B_8$ in an atomic ratio was provided in the form of an 8 mm-wide and 20 μm-thick thin strip.

Figure 7B:
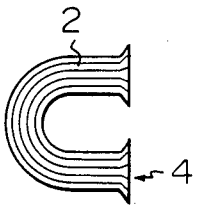
FIGS. 7A through 7C are an elevational view, a top view, and a front view, respectively, of an amorphous cut core of an example.
Figure 7A:
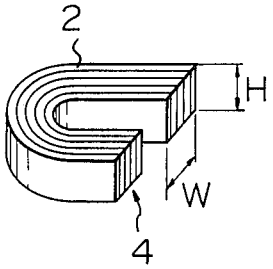
Figure 7C:
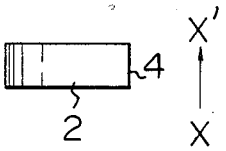

Seven wound bodies in a toroidal form, having an inner diameter of 19 mm and an outer diameter of 31 mm, were prepared, and resin was impregnated into them. Each of the wound bodies was cut into halves to provide C-shaped pieces (FIGS. 7A through 7C). Due to cutting of the wound bodies in the direction X-X', burrs 2B were generated at the cut ends 4. The cut ends of the C-shaped wound cores were 8.4 mm in height (H) and 7.2 mm in width (W). The C-shaped pieces were polished with a resinoid grinding tool over a period of 20 seconds. The polishing direction is shown in the table below.

TABLE 1

| Sample No. | Polishing Direction (Angle θ Relative to a Direction Parallel to Major Surfaces) | | Polishing Time | $t_B/(t_B - t_0)$ | Watt Loss (mW/cm³) | Restoration (%) | Permeability μ |
|---|---|---|---|---|---|---|---|
| 1 (Comparative) | Rotational* | | 20 sec | 1.25 | 210 | 16 | 1460 |
| 2 (Comparative) | Straight | 90° | " | 1.3 | 228 | 9 | 1230 |
| 3 (Comparative) | Straight | 45° | " | 1.25 | 215 | 14 | 1340 |
| 4 (Invention) | Straight | 30° | " | 1.1 | 186 | 26 | 1760 |
| 5 (Invention) | Straight | 15° | " | 1.05 | 175 | 30 | 1960 |
| 6 (Invention) | Straight | 0° | " | 1.05 | 170 | 32 | 2050 |
| 7 (Invention) | Rotational+ | | 15 sec | 1.05 | 173 | 31 | 1900 |
| | Straight | 0° | 5 sec | | | | |

*Radius of polishing circle = 125 mm
+Radius of polishing circle = 125 mm

The watt loss of Sample Nos. 1 through 7 was measured after cutting and after polishing.

The watt loss after polishing is given in the table by the restoration ratio defined by the following percentage:

$$\frac{\text{watt loss after cutting} - \text{watt loss after polishing}}{\text{watt loss after cutting}} \times 100\%$$

Sample Nos. 1 through 3 were further subjected to chemical polishing and lapping. In this case, the restoration percentage was approximately 30%. Then Sample Nos. 1 through 7 were exposed inside a room for 1,000 hours. Rust formed over the entire cut surfaces of Sample Nos. 1 through 3, but no rust formed on the cut surfaces of Sample Nos. 4 through 7.

We claim:

1. An amorphous cut core having a predetermined shape and comprising:

a wound body of a thin strip of magnetic amorphous alloy, said wound body having wound inner and outer surfaces including an open gap between layers of the wound thin strip of magnetic amorphous alloy, and a cut surface being formed across the wound thin strip of magnetic amorphous alloy, said predetermined shape being defined by said wound inner and outer surfaces, characterized in that the cut surface has polishing marks in a direction substantially parallel to a major surface thereof, the thickness of the thin strip of magnetic amorphous alloy, at the cut surface of the wound thin strip is 1.2 times or less the thickness of the thin strip of magnetic amorphous alloy at the remaining non-cut portion of the wound thin strip, and the cut core has no trapped acid in the gaps between the layers of strips of magnetic amorphous alloy.

* * * * *